US005329658A

United States Patent [19]

Fontenot et al.

[11] Patent Number: 5,329,658

[45] Date of Patent: Jul. 19, 1994

[54] BLANKET ELEVATOR APPARATUS

[76] Inventors: Marie Fontenot; Lyence Cuvillier, both of Rt. 1, Box 265, Buchanan Dam, Tex. 78609

[21] Appl. No.: 139,762

[22] Filed: Oct. 22, 1993

[51] Int. Cl.[5] ..... A47C 21/02

[52] U.S. Cl. ..... 5/505.1; 5/504.1

[58] Field of Search ..... 5/505.1, 506.1, 504.1, 5/503.1, 658; 24/72.5

[56] References Cited

U.S. PATENT DOCUMENTS

| | | | |
|---|---|---|---|
| 2,602,171 | 7/1952 | Good | 5/505.1 |
| 2,668,963 | 2/1954 | Drake | 5/505.1 |
| 3,680,158 | 8/1972 | Speed | 5/505.1 |
| 4,712,262 | 12/1987 | Viggiano | 24/72.5 |
| 4,860,398 | 8/1989 | Karpinski | 24/72.5 |
| 4,975,997 | 12/1990 | Misiura et al. | 5/505.1 |

*Primary Examiner*—Alexander Grosz

*Attorney, Agent, or Firm*—E. Michael Combs

[57] ABSTRACT

A framework arranged to permit spacing of a blanket above an associated mattress includes spaced U-shaped clips arranged for mounting upon side rails of the associated bed frame, with each of the clip members having a base tube receiving a U-shaped frame adjustably therethrough to permit selective positioning and spacing of the U-shaped frame above an uppermost mattress to receive the blanket thereon to permit spacing of the blanket relative to the mattress.

4 Claims, 4 Drawing Sheets

BLANKET ELEVATOR APPARATUS

BACKGROUND OF THE INVENTION

1. Field of the Invention

The field of invention relates to bedding support apparatus, and more particularly pertains to a new and improved blanket elevator apparatus arranged to adjustably position a blanket relative to an associated mattress arrangement.

2. Description of the Prior Art

Various bedding support structure has been indicated in the prior art such as U.S. Pat. Nos. 4,570,275; 4,190,915; 3,680,158; 4,493,121; and 4,975,997.

The instant invention is arranged to address deficiencies in the prior art by providing for a support framework arranged to permit ease of positioning in an adjustable relationship of an associated blanket relative to an adjacent mattress and in this respect, the present invention substantially fulfills this need.

SUMMARY OF THE INVENTION

In view of the foregoing disadvantages inherent in the known types of bedding support apparatus now present in the prior art, the present invention provides a blanket elevator apparatus wherein the same is arranged to permit positioning of a blanket relative to a mattress in an adjustable relationship. As such, the general purpose of the present invention, which will be described subsequently in greater detail, is to provide a new and improved blanket elevator apparatus which has all the advantages of the prior art bedding support apparatus and none of the disadvantages.

To attain this, the present invention provides a framework arranged to permit spacing of a blanket above an associated mattress, including spaced U-shaped clips arranged for mounting upon side rails of the associated bed frame, with each of the clip members having a base tube receiving a U-shaped frame adjustably therethrough to permit selective positioning and spacing of the U-shaped frame above an uppermost mattress to receive the blanket thereon to permit spacing of the blanket relative to the mattress.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved blanket elevator apparatus which has all the advantages of the prior art bedding support apparatus and none of the disadvantages.

It is another object of the present invention to provide a new and improved blanket elevator apparatus which may be easily and efficiently manufactured and marketed.

It is a further object of the present invention to provide a new and improved blanket elevator apparatus which is of a durable and reliable construction.

An even further object of the present invention is to provide a new and improved blanket elevator apparatus which is susceptible of a low cost of manufacture with regard to both materials and labor, and which accordingly is then susceptible of low prices of sale to the consuming public, thereby making such blanket elevator apparatus economically available to the buying public.

Still yet another object of the present invention is to provide a new and improved blanket elevator apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
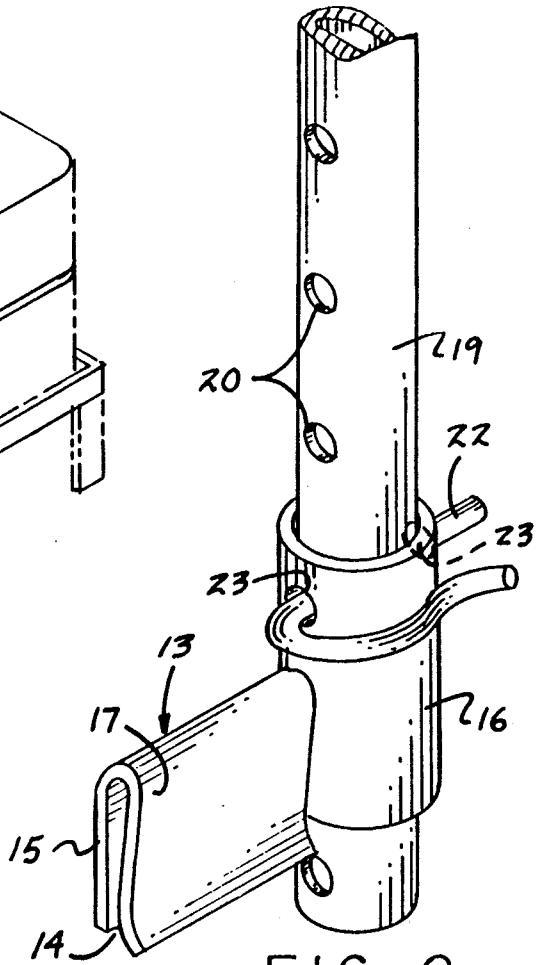
FIG. 2 is an enlarged isometric illustration of an individual clip member employed by the invention.

With reference now to the drawings, and in particular to FIGS. 1 to 7 thereof, a new and improved blanket elevator apparatus embodying the principles and concepts of the present invention and generally designated by the reference numerals 10 and 10*a* will be described.

Figure 1:
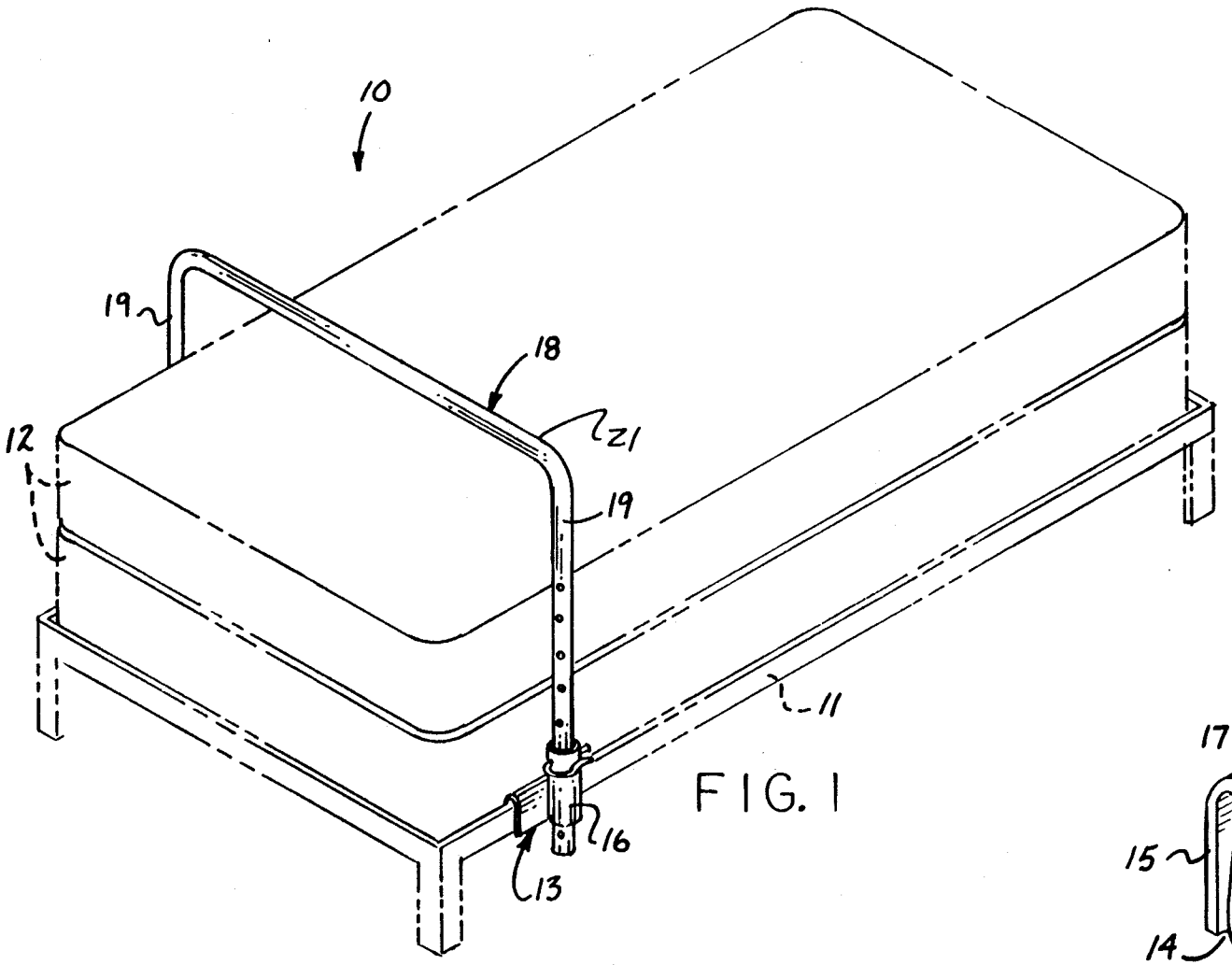
FIG. 1 is an isometric illustration of the invention in use.

More specifically, the blanket elevator apparatus 10 of the instant invention essentially comprises a cooperating bed frame having bed frame spaced side rails 11 of conventional construction, wherein a plurality of bed mattress members 12 are mounted upon the bed frame. A U-shaped clip 13 is mounted to each of the side rails 11 (it is indicated that only one such U-shaped clip 13 is indicated in FIG. 1, but it should be understood that a mirror image identical such U-shaped clip 13 is mounted to the opposing bed frame side rail 11), with the U-shaped clip having an entrance opening 14 to receive an associated side rail 11 within the clip, with generally U-shaped ends 15 defining the extremities of the U-shaped clip, with a U-shaped front flange 17 fixedly mounting a base tube 16 thereon, with the base tube projecting above the U-shaped clip, such that the base tube includes cooperating aligned base tube bores 23, with the base tube bores positioned in a spaced relationship relative to the clip 13 to provide manual access to a lock pin 22 without interference from the clip structure 13. A U-shaped frame 18 is provided having spaced parallel frame legs 19, with each of the frame legs 19 received within an individual one of the base tubes 16. The U-shaped frame 18 includes a connecting leg 21 extending substantially orthogonally between the frame legs 19, with each of the connecting legs 21 having a row of adjustment apertures 20 directed therethrough. In this manner, the adjustment apertures 20 are aligned with the base tube bores 23 and the lock pin 22 directed therethrough to provide for elevational positioning of the U-shaped frame 18 relative to an uppermost mattress 12, whereupon a blanket member (illustrated in FIG. 7) is merely positioned over the U-shaped frame 18 to space the blanket from an individual's legs in use.

Figure 4:
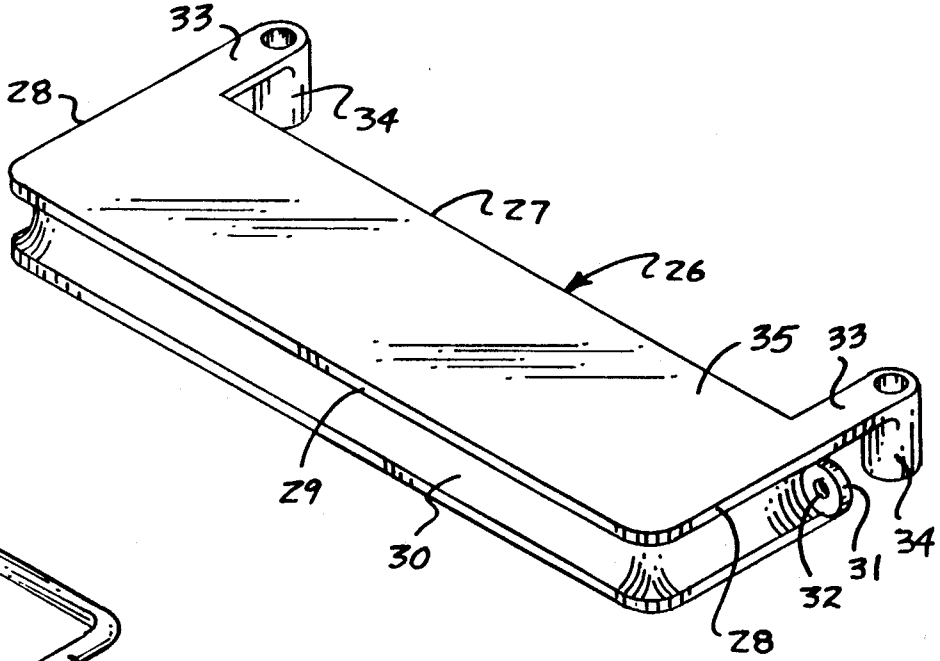
FIG. 4 is an isometric illustration of the associated blanket lock plate structure arranged for employment by the modified apparatus.
Figure 3:
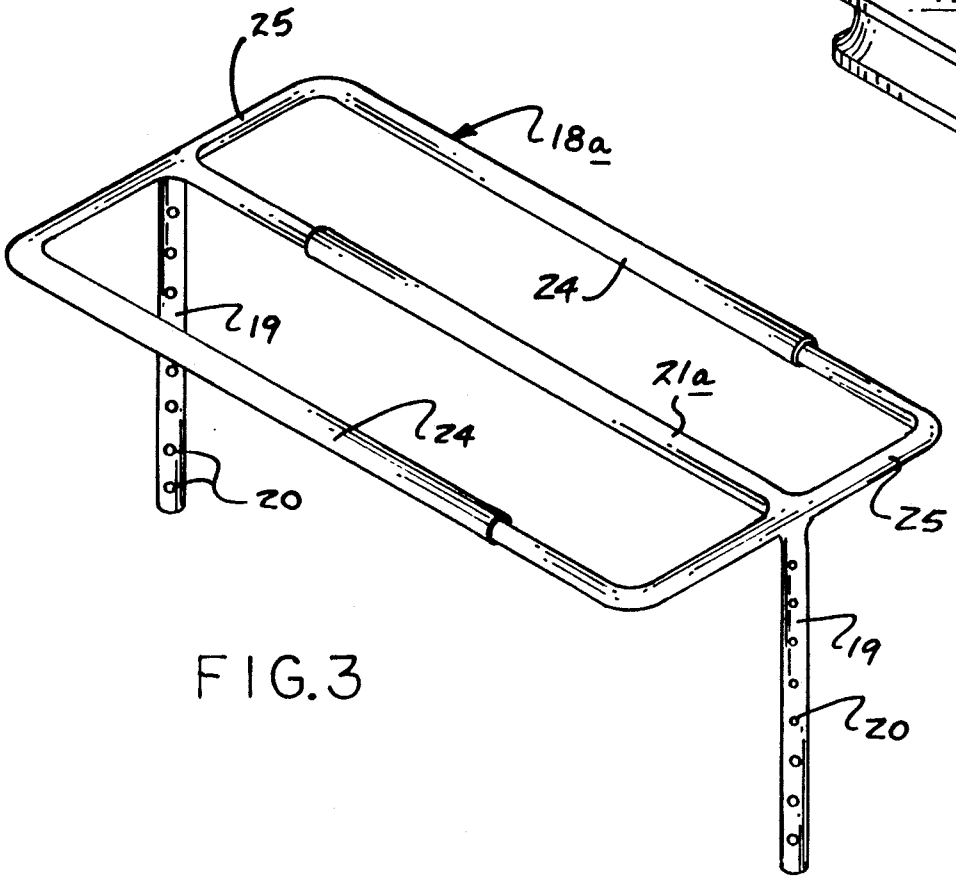
FIG. 3 is an isometric illustration of a modified support frame structure.
Figure 5:
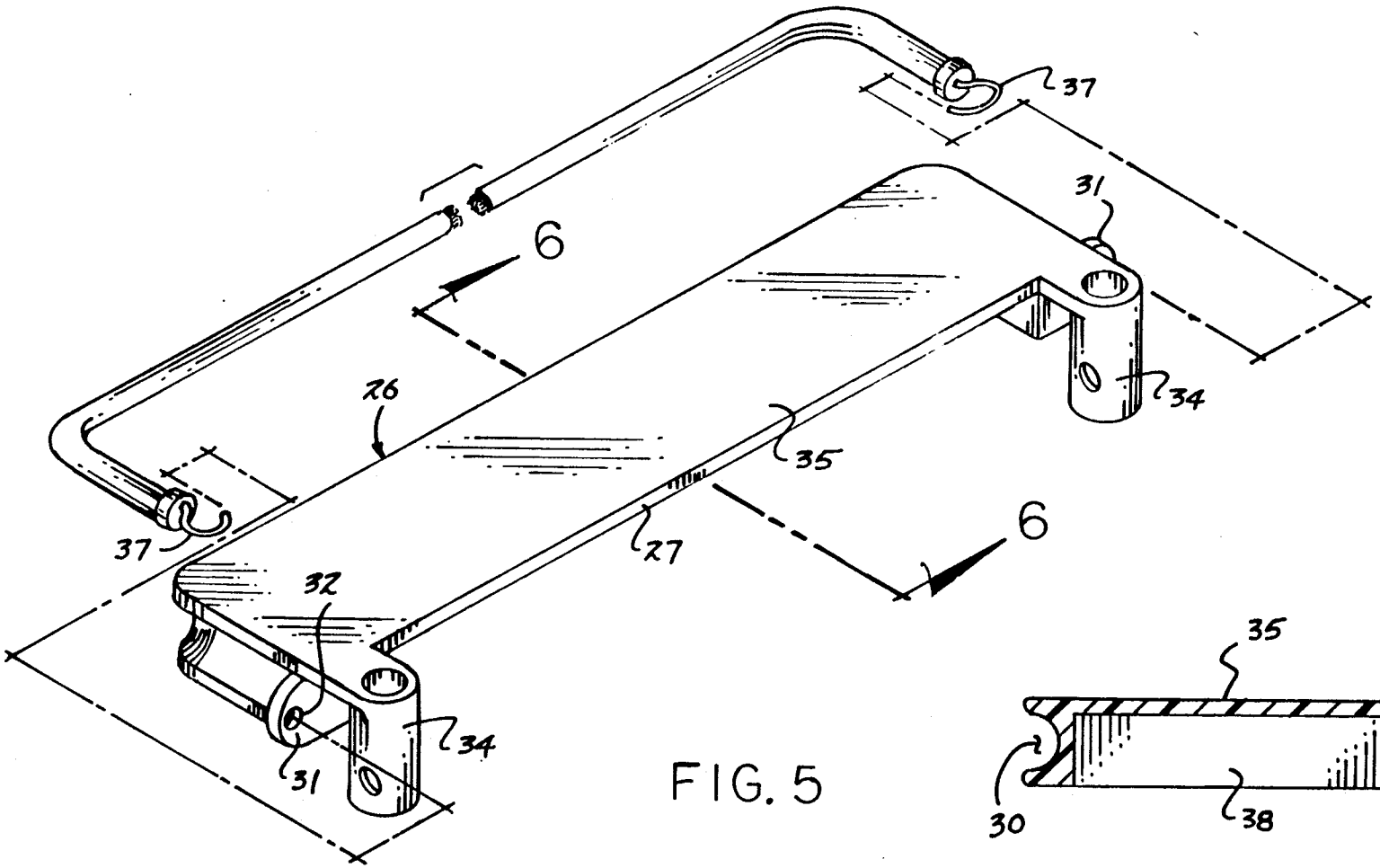
FIG. 5 is an isometric illustration of the blanket lock plate structure in an isometric view.
Figure 6:
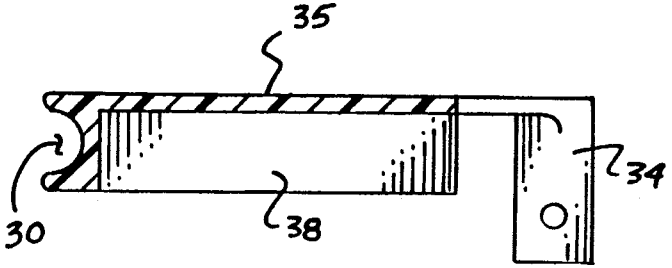
FIG. 6 is an orthographic view, taken along the Lines 6—6 of FIG. 5 in the direction indicated by the arrows.
Figure 7:
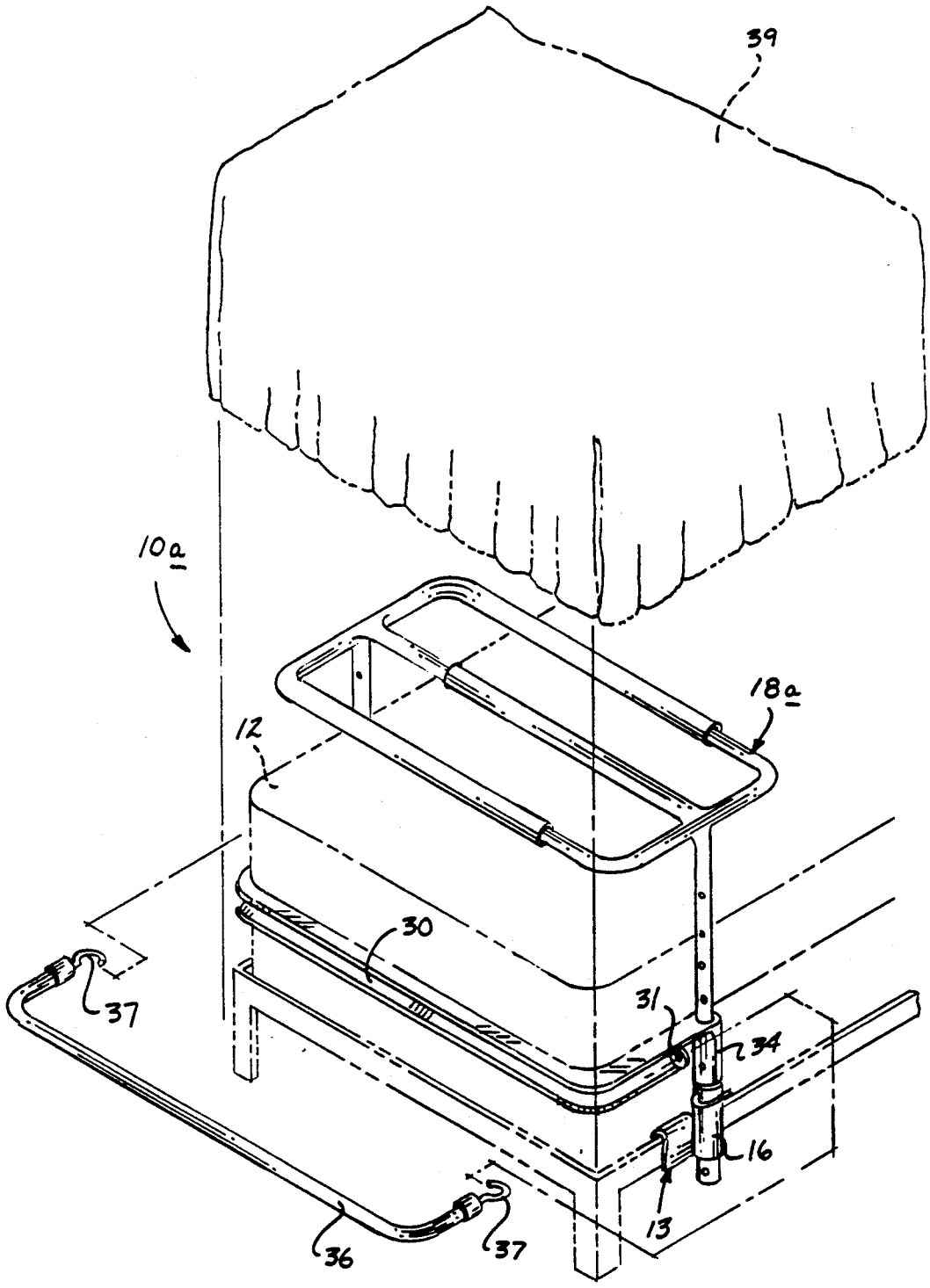
FIG. 7 is an isometric illustration of the modified blanket apparatus arranged in use.

The apparatus 10*a*, as indicated in FIG. 7, is arranged to provide for enhanced support of the blanket 39 positioned over a modified U-shaped frame 18*a*, with additionally, a blanket lock plate 26, of the type as indicated in the FIGS. 4 and 5, employed to secure the periphery of the blanket 39 against the mattress structure 12 to arrest the blanket and its movement relative to the mattress structure.

The modified U-shaped frame 18*a* includes a modified connecting leg 21*a* telescopingly arranged with additional lateral support tubes 24 also of telescoping construction to provide for accommodation of various mattress widths in use.

The blanket lock plate, of a type as indicated in the FIGS. 4 and 5, includes a plate top wall 35, with a plate rear wall 27, spaced plate side walls 28, and a plate front wall 29. A U-shaped groove 30 extends coextensively along the plate side walls 28 and the front wall 29, as the forward surface of a U-shaped flange 38 orthogonally projecting below the lock plate side and front walls 28 and 29, such as indicated in the FIGS. 4–6. In this manner, the U-shaped flange 38 provides for an abutment to a lowermost mattress 12 to properly align and orient the lock plate structure 26 relative to the spaced mattresses in use, such as indicated in the FIG. 7. A connecting flange 31 extends orthogonally from the ends of the U-shaped groove 30 at the side walls 28, with each of the connecting flanges 31 having a flange aperture 32. A resilient tether line 36 is provided, having tether line hooks 37 at each end of the tether line, with each of the hooks 37 arranged for reception within an individual one of the flange apertures 32 to thereby capture the blanket 39 between the resilient tether line 36 and the U-shaped groove 30 and arrest its relative movement relative to the mattress structure 12, as well as to the apparatus 10*a*. The lock plate 26 further includes extension legs 33 extending beyond the rear wall 27 colinearly with the plate side walls 28, such that each of the extension legs 33 terminates in a leg tube 34 oriented orthogonally relative to the plate top wall 35, such that each leg tube 34 is arranged to receive an individual one of the frame legs 19 therethrough to interlock the blanket lock plate structure 26 relative to the U-shaped frame structure 18*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A blanket elevator apparatus, comprising, spaced clip members, each clip member arranged for receiving a bed frame side rail therewithin, and each clip member including an entrance opening to receive said side rail and a front flange, and a base tube integrally mounted to the front flange projecting above the clip member, and a U-shaped frame, the U-shaped frame having spaced parallel frame legs arranged in a coextensive relationship relative to one another, with each of the frame legs arranged for sliding reception within a respective said base tube, and each frame leg having a row of adjustment apertures directed therethrough, and the base tube having aligned base tube bores, and a lock pin arranged for reception through one of said adjustment apertures and through the base tube bores, said apparatus further including a blanket lock plate comprised of a U-shaped flange having a U-shaped groove facing exteriorly of said lock plate and a resilient tether line adapted to frictionally retain a portion of a blanket within said groove.

2. An apparatus as set forth in claim 1 wherein said blanket lock plate has a top wall and spaced side walls, a front wall, and a rear wall, with a U-shaped flange extending from the top wall along the front wall and the side walls, and the U-shaped groove has groove terminal ends, and each of said terminal ends include a connecting flange, each connecting flange includes a flange aperture, the resilient tether line having tether line distal ends, each said distal ends having a hook, and each said hook being arranged for reception within a respective said flange aperture.

3. An apparatus as set forth in claim 2 wherein the lock plate includes a plurality of extension legs, with an individual one of said extension legs extending integrally to the lock plate rear wall, with each of the extension legs oriented coplanar relative to the plate top wall, and each of the extension legs having a leg tube, each leg tube slidably receiving one of said frame legs therethrough.

4. An apparatus as set forth in claim 3 wherein the U-shaped frame includes a telescoping connecting leg extending between the spaced frame legs, and further including telescoping lateral support tubes oriented parallel relative to the connecting leg.

* * * * *